US006622694B2

(12) United States Patent
Mickiewicz et al.

(10) Patent No.: US 6,622,694 B2
(45) Date of Patent: Sep. 23, 2003

(54) REDUCED NOISE ENGINE COMPRESSION RELEASE BRAKING

(75) Inventors: Matthew G. Mickiewicz, Clayton, NC (US); Steven J. Funke, Princeville, IL (US)

(73) Assignee: Caterpillar Inc, Peoria, IL (US)

( * ) Notice: Subject to any disclaimer, the term of this patent is extended or adjusted under 35 U.S.C. 154(b) by 91 days.

(21) Appl. No.: 09/917,962

(22) Filed: Jul. 30, 2001

(65) Prior Publication Data

US 2003/0019469 A1 Jan. 30, 2003

(51) Int. Cl.[7] ..... F02D 13/04
(52) U.S. Cl. ..... 123/322
(58) Field of Search ..... 123/320, 321, 123/322

(56) References Cited

U.S. PATENT DOCUMENTS

| | | | | |
|---|---|---|---|---|
| 4,981,119 | A | | 1/1991 | Neitz et al. |
| 5,146,890 | A | * | 9/1992 | Gobert et al. ..... 123/321 |
| 5,406,918 | A | | 4/1995 | Joko et al. |
| 5,485,819 | A | | 1/1996 | Joko et al. |
| 5,586,531 | A | | 12/1996 | Vittorio |
| 5,647,318 | A | | 7/1997 | Feucht et al. |
| 5,724,939 | A | | 3/1998 | Faletti et al. |
| 5,813,231 | A | | 9/1998 | Faletti et al. |
| 5,921,216 | A | | 7/1999 | Ballman et al. |
| 6,000,374 | A | | 12/1999 | Cosma et al. |
| 6,170,474 | B1 | | 1/2001 | Israel |
| 6,234,143 | B1 | | 5/2001 | Bartel et al. |
| 6,237,551 | B1 | | 5/2001 | Macor et al. |
| 6,321,717 | B1 | * | 11/2001 | Faletti ..... 123/321 |
| 6,347,619 | B1 | * | 2/2002 | Whiting et al. ..... 123/568.12 |
| 6,418,720 | B1 | * | 7/2002 | Cornell et al. ..... 60/602 |
| 2002/0073705 | A1 | * | 6/2002 | Cornell et al. ..... 60/602 |

* cited by examiner

*Primary Examiner*—Henry C. Yuen
*Assistant Examiner*—Arnold Castro
(74) *Attorney, Agent, or Firm*—Liell & McNeil

(57) ABSTRACT

A number of engine operating strategies have been developed that allow for engine braking when combustion is not needed. In these strategies, air within the engine cylinder is compressed by the cylinder piston; however, rather than introducing fuel into the cylinder to facilitate a combustion event, the cylinder is opened to an exhaust manifold and the compressed air is vented, and the energy is released by the engine. However, it has been learned that the venting of this compressed air from the engine can produce undesirable noise emissions. Thus, the present invention employs a dual exhaust valve lift strategy to reduce noise produced during engine braking while still allowing relatively high engine braking horsepowers to be achieved.

20 Claims, 2 Drawing Sheets

(mm)
14
10
6
2
-2
1
2
3
4
5
6

(MPa)
6
4
2
0
3

(kPa)
500
400
300
200
50
1
3

IN
OUT
(kg/moc)
0.2
-0.2
-0.6
-1
-1.3
B
C
2

(kg/moc)
IN
OUT
0.3
0.2
0.1
0
-0.1
A
0
180
360
540
720
CRANK ANGLE (DEG)

REDUCED NOISE ENGINE COMPRESSION RELEASE BRAKING

TECHNICAL FIELD

The present invention relates generally to a method of engine compression release braking, and more particularly to a reduced noise method of engine compression release braking.

BACKGROUND

For a typical four stroke diesel engine, reciprocation of a movable piston between its top dead center and bottom dead center positions correspond to four stages of the engine's operation. When the piston retracts from top dead center for the first time, it is undergoing an intake stroke, and air can be drawn into the cylinder, typically via an intake valve. When the piston advances from bottom dead center for the first time, it is undergoing a compression stroke, and air within the cylinder can be compressed. At some point during the compression stroke, relatively late for traditional diesel engines and relatively early for homogeneous charge compression engines, fuel is injected into the cylinder. At the end of the compression stroke, combustion occurs within the cylinder and the piston is driven toward bottom dead center for a power stroke. Finally, as the piston advances toward top dead center, it undergoes an exhaust stroke, and post combustion products can be removed from the cylinder, typically via an exhaust valve. While this is the typical operation for a four cycle diesel engine, it is known in the art that injection and combustion are not always desirable during each engine cycle. A number of engine operating strategies have been developed in which engine braking, rather than injection and combustion, can occur during the engine cycle. In these engine operating strategies, the exhaust valve is opened at least once prior to the exhaust stroke to release energy within the cylinder, thus producing a retarding torque on the engine.

One braking strategy is commonly referred to as the single lift engine braking method. For this engine operating strategy, the exhaust valve is opened only one time prior to the exhaust stroke, when the cylinder piston is at or near top dead center for its compression stroke. While there are a number methods for carrying out the single lift strategy, one example of this engine braking strategy is disclosed in U.S. Pat. No. 5,586,531, which issued to Vittorio on Dec. 24, 1996. Vittorio discloses a single lift engine braking method in which the engine cylinder is opened to the exhaust manifold relatively early during the compression stroke, as opposed to later in the stroke when the cylinder piston is at or near its top dead center position. Depending on the structure of the engine brake, e.g. cams and or electrically controlled actuators, the breaking event can occur every, or every other, stroke of the piston from BDC to TDC. Single event engine braking is relatively noisy when cylinder blow down occurs near top dead center.

In addition to these single lift strategies, and in an effort to gain even more engine braking horsepower, a boosted dual lift strategy has been developed. Such a strategy is described in co-owned U.S. Pat. No. 5,724,939. For this engine braking strategy, the exhaust valve is opened two times prior to the exhaust stroke of the cylinder piston. First, the exhaust valve is opened near the end of the intake stroke of the cylinder piston to allow a small amount of additional air flow into the cylinder from the exhaust manifold. Then, the exhaust valve is re-opened near the end of the compression stroke to blow down compressed air for engine braking purposes. By introducing additional air from the exhaust manifold into the cylinder at the end of the intake stroke, the amount of air in the cylinder and the cylinder pressure that results from compression can be increased, thus leading to an increased amount of engine braking horsepower that is produced. While these strategies have shown promise in increasing braking horsepower, the side effect is increased noise.

The present invention is directed toward overcoming one or more of the problems set forth above.

SUMMARY OF THE INVENTION

In one aspect of the present invention, a method of engine compression release braking includes a step of opening an exhaust manifold to an engine cylinder during a portion of an intake stroke when exhaust manifold pressure is peaking. Gas in the engine cylinder is then compressed. The engine cylinder is opened to the exhaust manifold when cylinder pressure exceeds exhaust manifold pressure.

In another aspect of the present invention, a method of engine compression release braking includes a step of opening an exhaust manifold to an engine cylinder during a substantial portion of an intake stroke while an intake valve is open. Gas in the engine cylinder is then compressed. The engine cylinder is opened to the exhaust manifold when cylinder pressure exceeds exhaust manifold pressure.

In yet another aspect of the present invention, a method of engine compression release braking includes a step of opening an exhaust manifold to an engine cylinder when a cylinder piston is in a middle region between a top dead center position and a bottom dead center position. Gas in the engine cylinder is then compressed. The engine cylinder is opened to the exhaust manifold when cylinder pressure exceeds exhaust manifold pressure.

DETAILED DESCRIPTION

Figure 1:
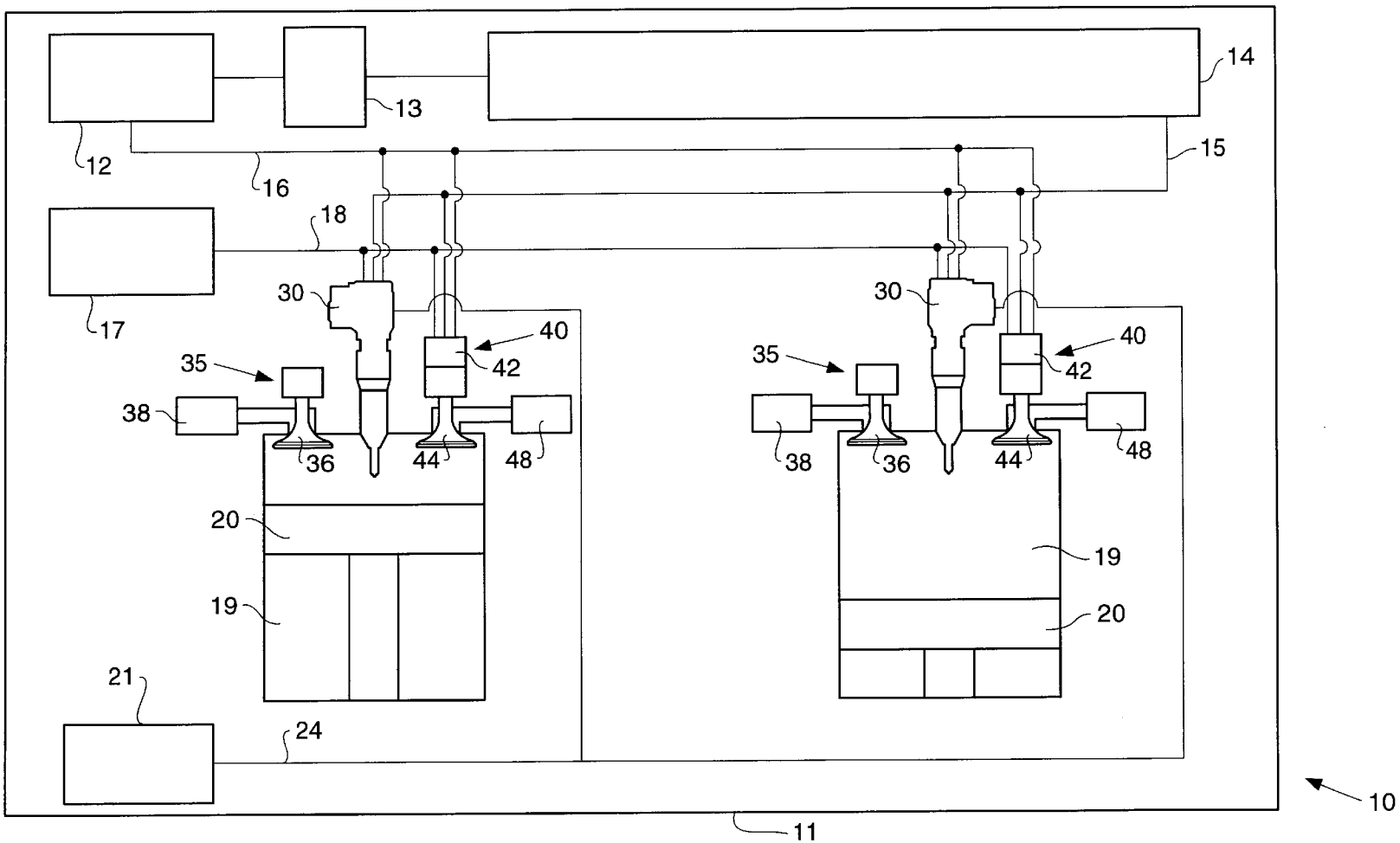
FIG. 1 is a schematic view of an engine according to the present invention.

Referring now to FIG. 1 there is illustrated an engine 10 according to the present invention. A low pressure reservoir 12 is included in engine 10 and preferably contains an amount of low pressure engine lubricating oil. While low pressure reservoir 12 is preferably an oil pan that contains an amount of engine lubricating oil, it should be appreciated that other fluid sources having an amount of available fluid, such as coolant, transmission fluid, or fuel, could instead be used. A high pressure pump 13 pumps oil from low pressure reservoir 12 and delivers the same to high pressure manifold 14. High pressure oil flowing out of high pressure manifold 14 is delivered via high pressure fluid supply line 15 to a hydraulic system included in engine 10, and oil is returned to low pressure reservoir 12 via low pressure return line 16 after it has performed work in the hydraulic system. Engine 10 also includes an engine housing 11 that defines a plurality of engine cylinders 19. Although the present invention is illustrated in the context of an electro-hydraulic engine brake actuator, the concepts of the present invention could also be applied to suitable mechanical and/or other electrically controlled systems.

Each cylinder 19 defined by engine housing 11 has a movable cylinder piston 20. Each piston 20 is movable between a bottom dead center position and a top dead center position. For a typical four cycle engine 10, the advancing and retracting strokes of piston 20 correspond to the four stages of engine 10 operation. When piston 20 retracts from its top dead center position to its bottom dead center position for the first time, it is undergoing an intake stroke. Air, can be drawn into cylinder 19 from an intake manifold 38 via an intake valve 35. An intake valve member 36 can open cylinder 19 to intake manifold 38 when a rotating cam or some other actuator engages intake valve 35. When piston 20 advances from its bottom dead center position to its top dead center position for the first time it is undergoing a compression stroke. At around the end of the compression stroke, fuel can be injected into cylinder 19 by fuel injector 30, and combustion within cylinder 19 can occur instantly, due to the high temperature of the compressed air. Ignition of the injected fuel drives piston 20 downward toward the bottom dead center position for its power stroke. Finally, when piston 20 once again advances from its bottom dead center position to its top dead center position, post combustion products remaining in cylinder 19 can be vented into an exhaust manifold 48 via exhaust valve 40, corresponding to the exhaust stroke of piston 20. As with intake valve member 36, an exhaust valve member 44 opens cylinder 19 to exhaust manifold 48 when a rotating cam or other actuator engages exhaust valve 40. While engine 10 has been illustrated as a four cycle, two cylinder engine, it should be appreciated that any desired number of cylinders can be defined by engine housing 11.

It is known in the art that injection and combustion are not always necessary, or desirable, during each cycle of piston 20. One such time might be when a vehicle including engine 10 is descending a relatively steep hill. During the descent, injection and combustion are not necessary, and instead braking is often desirable. To increase efficiency of engine 10, to decrease undesirable emissions created during unnecessary combustion and maybe most importantly to help slow the vehicle by assisting/relieve burden on the wheel brakes, exhaust valve 40 or a separate compression release brake valve is preferably capable of facilitating engine compression release braking. When combustion is not desired, fuel is not injected into cylinder 19 at the end of the compression stroke, but instead, the compression of air in cylinder 19 during the compression stroke provides a retarding torque on engine 10, and hence to the vehicle via the transmission. The energy is then released by a blow down into the exhaust manifold instead of being recovered as piston 20 retracts toward its downward position.

Preferably, exhaust valve 40 is operably coupled to an electro-hydraulic actuator 42 in addition to being mechanically coupled to a cam. Actuator 42 is operably positioned such that an exhaust valve member 44 can be opened independent of the rotating cam. Therefore, in addition to the cam actuated opening of exhaust valve member 44 during the exhaust stroke of piston 20, exhaust valve member 44 can also be moved to an open position during the intake and compression strokes of piston 20 by electro-hydraulic actuator 42. However, electro-hydraulic actuator 42 may not be capable of moving exhaust valve member 44 to its fully open position. Instead, actuator 42 need only be able to move exhaust valve member 44 away from its closed position such that a sufficient amount of gas flow between cylinder 19 and exhaust manifold 48 can occur. It has been learned that undesirable noise emissions can be created during an engine braking event. Thus, the present invention sets forth a strategy for reducing noise that is produced by engine braking while still providing for sufficient engine braking horsepower. Preferably, the engine braking strategy of the present invention includes a dual lift engine braking event. In other words, exhaust valve 40 is opened twice by electro-hydraulic actuator 42 prior to the exhaust stroke of piston 20, in addition to being opened during the exhaust stroke by the cam.

According to the preferred reduced noise engine braking strategy of the present invention, exhaust valve 40 is preferably opened for the first time during a middle portion of the intake stroke of piston 20. This portion of the intake stroke can be thought of as the time period when piston 20 is moving through a middle region between its top dead center position and its bottom dead center position. In terms of crank angle, if the intake stroke of piston 20 begins when the crank angle is 0° and ends when the crank angle is 180°, the piston 20 would be moving through the middle region between its top dead center position and its bottom dead center position when the crank angle is between 60° and 120°. In addition, exhaust valve 40 is preferably maintained in this open position until after intake valve 35 is closed and piston 20 has begun its compression stroke, as described below. The exhaust valve is preferably closed before air in the cylinder is lost to the exhaust manifold. Thus, exhaust manifold 48 will be open to cylinder 19 during a substantial portion of the intake stroke. Therefore, cylinder 19 can be simultaneously filled with air from both exhaust manifold 48 and intake manifold 38 for a substantial portion, about half, of the intake stroke. Exhaust valve 40 is then opened for a second time by electro-hydraulic actuator 42 at or near the end of the compression stroke to allow compressed gas within cylinder 19 to be vented to exhaust manifold 48. Finally, exhaust valve 40 is fully opened by the cam during the exhaust stroke of piston 20.

This timing of the opening of exhaust valve 40 during the intake stroke is desirable for reducing noise emissions produced by engine 10. By opening cylinder 19 to exhaust manifold 48 during a middle portion of the intake stroke, the pressure within exhaust manifold 48 will be peaking. In other words, because another cylinder will be undergoing its blow down while cylinder 19 is undergoing its intake stroke, compressed gas from the other cylinder will be flowing into exhaust manifold 48 raising pressure therein. Therefore, by opening cylinder 19 to exhaust manifold 48 when exhaust manifold pressure begins to exceed intake manifold pressure, less air will be drawn into cylinder 19 from intake manifold 38. Therefore, cylinder 19 can be partially filled by air from exhaust manifold 48. Because the compressed air from the other cylinder will be directed into cylinder 19, rather than being vented from the engine, the noise associated with expelling the compressed air from the engine can be reduced and the peak exhaust manifold pressure will also be decreased. Lower noise emissions are believed to be a result of less engine venting accompanied by a lowering of exhaust manifold pressure.

In addition to considerations regarding the opening of exhaust valve 40 during the intake stroke for the reduced noise engine braking strategy of the present invention, timing of the closing of exhaust valve 40 is also important. For instance, in order to allow compressed air that has been vented to exhaust manifold 48 from another cylinder to be directed to cylinder 19, rather than being vented from engine 10, it should be appreciated that it will be desirable to allow cylinder 19 to be opened to exhaust manifold 48 for a relatively long duration, for instance for the remainder of the intake stroke. This statement is likely true for a cam driven intake valve. However, if the engine was camless, then the intake valve would likely be closed sooner (that is sooner than a cam driven intake event) and then the exhaust valve would be opened to get the rest of the air into the cylinder. Since the intake valve would be closed earlier, the exhaust valve would not have to be opened for a long duration. Timing and duration would likely be comparable to the dual lift and first lift. However, it should also be appreciated that as piston 20 begins to advance from its bottom dead center position to its top dead center position for its compression stroke, air will be forced out of cylinder 19 and into exhaust manifold 48 as long as exhaust valve 40 remains open. With less air to be compressed within cylinder 19, a lower amount of engine braking will result. Thus, exhaust valve 40 is preferably closed after intake valve 35 is closed, but prior to the change in air flow from a direction flowing from exhaust manifold 48 into cylinder 19 to a direction flowing from cylinder 19 to exhaust manifold 48. Therefore, a reduction in the noise emissions produced by engine 10 can result without a significant reduction in the amount of engine braking that is achieved. This is possible because a similar amount of gas to a single event braking strategy is compressed, but the source of that gas is partially from the exhaust side. Gas within cylinder 19, which has been provided by both intake manifold 38 and exhaust manifold 48, will be compressed by piston 20 during its compression stroke. When pressure within cylinder 19 exceeds exhaust manifold 48 pressure, exhaust valve 40 will be reopened to allow the compressed gas to be vented for engine braking purposes. Blow down would preferably occur at or near top dead center in order to increase braking horsepower.

It should be appreciated that at least one set of engine operating test iterations will need to be performed on a given engine to allow for a determination of the appropriate timing for the opening and closing of exhaust valve 40 to optimize performance of the engine braking strategy of the present invention. For instance, engine 10 could be first operated in a single event engine braking mode, in which exhaust valve 40 is not opened until the end of the compression stroke of piston 20. During this iteration, the pressure in exhaust manifold 48 could be graphed, and the timing of the peak exhaust manifold pressure determined. This will yield the desired opening time for exhaust valve 40. A second iteration could then be performed in which exhaust valve 40 is opened prior to the expected peak exhaust manifold pressure. During this iteration, the timing of the gas flow properties between cylinder 19 and exhaust manifold 48 would be observed. In other words, the time, or crank angle, should be noted when the gas ceases flowing into cylinder 19 from exhaust manifold 48 and begins to flow out of cylinder 19 and into exhaust manifold 48. This iteration will yield the desired closing time for exhaust valve 40. The closing of exhaust valve 40 will typically be after, or about contemporaneously, with the closing of intake valve 35.

INDUSTRIAL APPLICABILITY

Referring to FIG. 1, and in addition to the graphs in FIGS. 2*a–e*, operation of the present invention will be discussed for one engine cylinder 19. It should be appreciated that while different cylinders are operating at different stages of their intake-compression-power-exhaust cycles at one time, the present invention operates in the same manner for each cylinder but with different absolute, but similar relative timing. The graphs illustrated in FIGS. 2*a–e* include exhaust valve member lift, cylinder pressure, exhaust manifold pressure, exhaust flow and intake flow versus crank angle. In addition, and for comparison purposes, the graphs in FIGS. 2*a–e* include not only the engine characteristics for the present invention, indicated by a dotted line, but also include the engine characteristics for both the single lift engine braking strategy, indicated by a solid line, and the boosting dual lift strategy, indicated by X's.

Prior to the intake stage for cylinder 19, electronic control module 17 evaluates the operating conditions for engine 10 and determines if fuel injection or engine braking is desirable for the upcoming piston 20 cycle for cylinder 19. Just prior to the intake stroke, the cam that is mechanically linked to intake valve 35 rotates to engage intake valve member 36 and to open cylinder 19 to intake manifold 38, indicated by the dashed line in FIG. 2*a*. As discussed earlier, event timings would likely change with respect to a camless engine without changing the effect of the events on braking. As piston 20 moves downward toward its bottom position it draws air into cylinder 19 via intake valve 35. If electronic control module 17 has determined that engine braking is desired, as opposed to fuel injection, electro-hydraulic actuator 42 is activated by electronic control module 17 just prior to when piston 20 begins moving through the middle region of its movement between its top dead center position and its bottom dead center position.

Figures 2A, 2B, 2C, 2D, 2E:
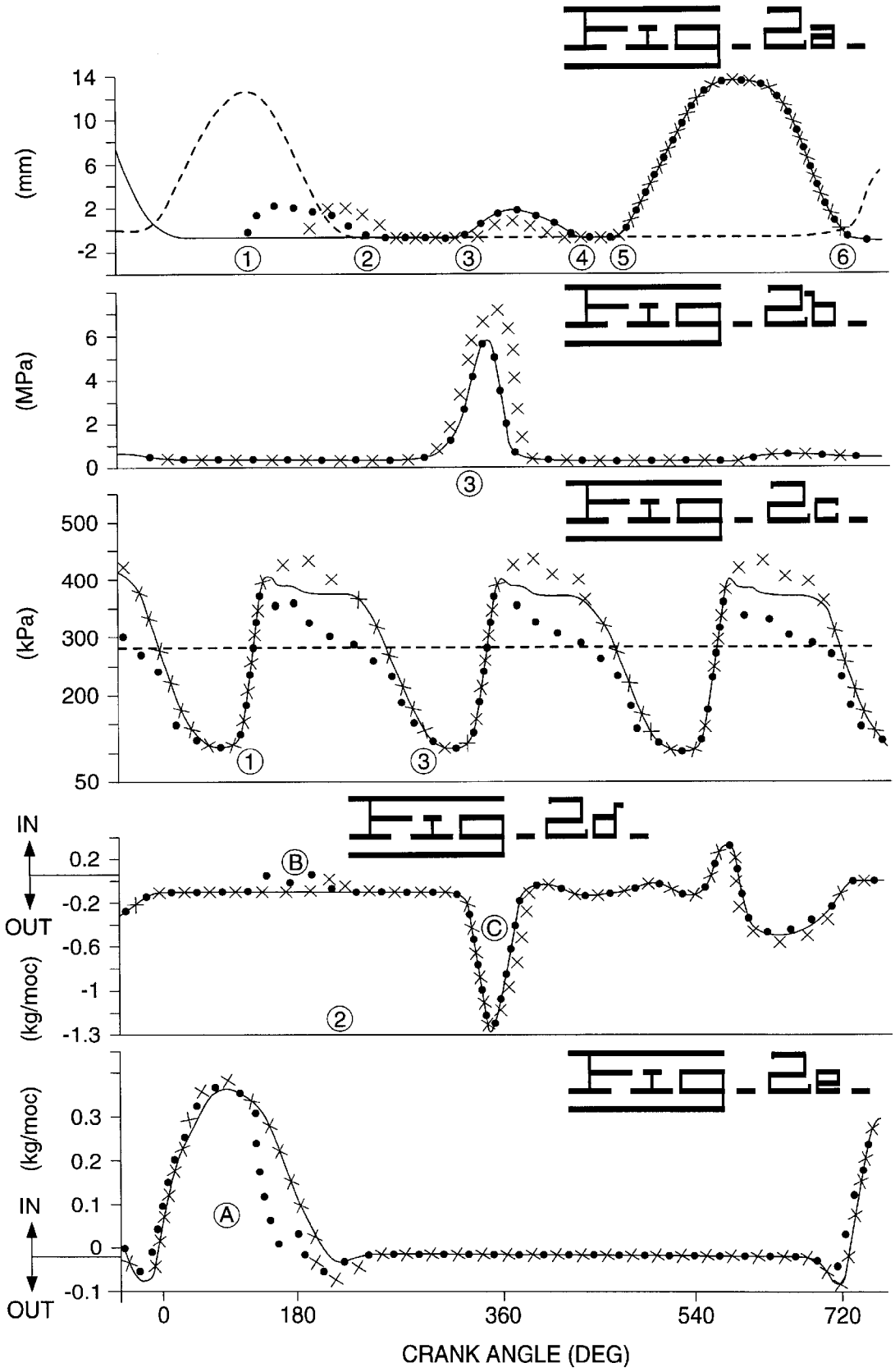
FIGS. 2*a–e* are graphical representations of valve lift, cylinder pressure, exhaust manifold pressure, exhaust flow and intake flow versus crank angle for a single engine braking event for the engine of FIG. 1.

When electro-hydraulic actuator 42 is activated, exhaust valve member 44 is moved away from its closed position opening cylinder 19 to exhaust manifold 48 (Time 1, FIG. 2*a*). Recall, however, that electro-hydraulic actuator 42 may not be capable of moving exhaust valve member 44 to its fully open position. However, it is capable of moving exhaust valve member 44 to a position that sufficiently opens exhaust manifold 48 to cylinder 19. As indicated previously, cylinder 19 is preferably opened to exhaust manifold 48 when exhaust manifold pressure (Time 1, FIGS. 2*a–c*) exceeds intake manifold pressure, which is indicated by the dashed line on FIG. 2*c*. Thus, cylinder 19 is simultaneously opened to both intake manifold 38 and exhaust manifold 48. Because cylinder 19 is opened to both intake manifold 38 and exhaust manifold 48, and because the pressure within exhaust manifold 48 exceeds the pressure within intake manifold 38, the amount of gas that flows into cylinder 19 from intake manifold 38 will be less than for a traditional single lift engine braking event (Region A, FIG. 2*e*). Or, in the camless alternative, the intake valve could be closed earlier, leading to less intake manifold air introduction. In addition, because exhaust manifold 48 is open to cylinder 19 for a substantial amount of time during the intake stroke, the amount of gas that flows into cylinder 19 from intake manifold 38 will be less than for the prior art boosted horsepower dual lift engine braking event (Region A, FIG. 2*e*). Additionally, the amount of gas that flows into cylinder 19 from exhaust manifold 48 for the present engine braking strategy will be more than the amount of gas that would flow into cylinder 19 when engine 10 is operating under the single lift and may even be more than the boosted dual lift strategies (Region B, FIG. 2*d*). Upon reaching its bottom dead center position, the intake stroke is ended and piston 20 begins to advance toward its upward position to compress the air that has been drawn into cylinder 19.

As piston 20 begins moving toward its top dead center position, exhaust valve member 44 is closed by electro-hydraulic actuator 42 (Time 2, FIG. 2*a*). Just prior to piston 20 reaching its top dead center position, electro-hydraulic actuator 42 is re-energized and exhaust valve member 44 is moved to once again open cylinder 19 to exhaust manifold 48 (Time 3, FIG. 2*a*). Recall that exhaust valve 40 is re-opened after cylinder pressure exceeds exhaust manifold pressure (Time 3, FIGS. 2*b* and 2*c*). Thus, the gas that has been compressed within cylinder 19 can be vented toward exhaust manifold 48 (Region C, FIG. 2*d*). This blow down event is preferably timed to produce a desired braking horsepower. A cylinder filling event on a different cylinder is preferably timed to coincide with a different cylinder's blow down event. Once a sufficient amount of compressed gas has been vented from cylinder 19, electro-hydraulic actuator 42 is de-energized and exhaust valve member 44 is returned to a position blocking cylinder 20 from exhaust manifold 48 (Time 4, FIG. 2*a*).

As piston 20 reaches its bottom dead center position and begins to move toward its top dead center position, the cam that is mechanically linked to exhaust valve 40 continues to rotate. Exhaust valve 40 is engaged by the cam and exhaust valve member 44 is moved to its open position once again fluidly connecting cylinder 19 to exhaust manifold 48 (Time 5, FIG. 2*a*). However, it should be appreciated that while exhaust valve 40 has been described as closing prior to the exhaust stroke of piston 20, this is not necessary. For instance, it should be appreciated that exhaust valve member 44 could remain away from its closed position until the cam rotates around to engage exhaust valve 40 to move exhaust valve member 44 to its fully open position. Recall that if fuel had been ignited within cylinder 19 during the combustion stroke of piston 20, post combustion residue could be vented at this time. As the cam continues to rotate, exhaust valve member 44 is returned to its closed position blocking cylinder 19 from exhaust manifold 48 (Time 6, FIG. 2*a*).

It should be appreciated that a number of modifications could be made to the present invention as disclosed herein. For instance, while engine 10 has been illustrated including cam-actuated intake and exhaust valves, the engine braking strategy of the present invention will be equally useful in engines having hydraulically or electrically actuated intake and/or exhaust valves. The invention also contemplates camless intake and/or exhaust valve actuation. Additionally, while the actuator that opens the exhaust valve against the movement of the cam has been described as an electro-hydraulic actuator, it should be appreciated that other suitable actuators could instead be utilized. For instance, a piezo-electric actuator could find application for this purpose.

The present invention exploits a discovery that engine braking noise is strongly correlated to, and likely causely linked to, peak exhaust manifold pressure. The present invention combines this knowledge with a desire to match the braking horsepower of single event braking but with reduced noise. This is accomplished by filling the cylinder with roughly the same amount of gas as from a single event, but by using gas from both the exhaust and intake instead of intake alone. Nevertheless, the concepts of the present invention also have the ability to produce lower noise higher horsepower braking by possibly having a hybrid boosted/low noise cycle. Finally, the present invention could also be used to create very low noise, low horsepower braking events, such as by blowing down relatively early in the compression stroke.

Thus, those skilled in the art will appreciate that other aspects, objects and advantages of this invention can be obtained from a study of the drawings, the disclosure and the appended claims.

What is claimed is:

1. A method of reduced noise engine compression release braking, comprising the steps of:

opening an exhaust manifold to an engine cylinder during a portion of an intake stroke when exhaust manifold pressure is peaking;

filling said engine cylinder with an amount of gas corresponding to a single event braking strategy in which the engine cylinder is filled only from an intake manifold;

compressing said gas in said engine cylinder; and opening said engine cylinder to said exhaust manifold when cylinder pressure exceeds exhaust manifold pressure.

2. The method of claim 1 including a step of opening an intake valve during at least a portion of said intake stroke.

3. The method of claim 2 including a step of simultaneously filling said engine cylinder from said exhaust manifold and said intake manifold for a substantial portion of said intake stroke.

4. The method of claim 2 including the steps of:

closing an intake manifold to said engine cylinder; and closing said exhaust manifold to said engine cylinder.

5. The method of claim 1 wherein said step of opening said exhaust manifold to said engine cylinder includes a step of opening said exhaust manifold to said engine cylinder when an exhaust manifold pressure exceeds an intake manifold pressure.

6. The method of claim 1 wherein said step of opening said exhaust manifold includes a step of actuating an electro-hydraulic actuator.

7. The method of claim 1 wherein said step of opening said exhaust manifold includes a step of opening said exhaust manifold at a middle portion of said intake stroke.

8.A method of reduced noise engine compression release braking, comprising the steps of:

opening an exhaust manifold to an engine cylinder during a substantial portion of an intake stroke while an intake valve is open;

filling said engine cylinder with an amount of gas corresponding to a single event braking strategy in which the engine cylinder is filled only from an intake manifold;

compressing said gas in said engine cylinder; and opening said engine cylinder to said exhaust manifold when cylinder pressure exceeds exhaust manifold pressure.

9. The method of claim 8 wherein said step of opening said exhaust manifold includes a step of opening said exhaust manifold when said exhaust manifold pressure is peaking.

10. The method of claim 8 wherein said step of opening said exhaust manifold includes a step of opening said exhaust manifold at a middle portion of said intake stroke.

11. The method of claim 8 wherein said compressing step includes a step of closing said exhaust manifold to said engine cylinder and closing said intake valve.

12. The method of claim 11 wherein the step of closing said intake valve is performed before the step of closing said exhaust manifold to said engine cylinder.

13. The method of claim 8 including a step of a rotating cam engaging said intake valve.

14. The method of claim 8 wherein said step of opening said exhaust manifold includes a step of actuating an electro-hydraulic actuator.

15. A method of reduced noise engine compression release braking comprising:

opening an exhaust manifold to an engine cylinder when a cylinder piston is in a middle region between top dead center position and a bottom dead center position;

filling said engine cylinder with an amount of gas corresponding to a single event braking strategy in which the engine cylinder is filled only from an intake manifold;

compressing said gas in said engine cylinder; and opening said engine cylinder to said exhaust manifold when cylinder pressure exceeds exhaust manifold pressure.

16. The method of claim 15 wherein said step of opening said exhaust manifold includes a step of opening said exhaust manifold when said exhaust manifold pressure is peaking.

17. The method of claim 15 including a step of opening an intake valve during at least a portion of said intake stroke.

18. The method of claim 15 wherein said step of opening said exhaust manifold includes a step of actuating an electro-hydraulic actuator.

19. The method of claim 15 including the steps of:

closing an intake manifold to said engine cylinder; and closing said exhaust manifold to said engine cylinder.

20. The method of claim 15 wherein said step of opening said exhaust manifold to said engine cylinder includes a step of opening said exhaust manifold when an exhaust manifold pressure exceeds an intake manifold pressure.

* * * * *